US005144105A

United States Patent [19]

Briggs et al.

[11] Patent Number: 5,144,105

[45] Date of Patent: Sep. 1, 1992

[54] MICROWAVE HEATING APPARATUS WITH A COMBINED FOOD SCOOP AND DOOR

[76] Inventors: David H. Briggs, Manor House Farm, Silchester NR Reading RG7 2HL; Richard F. Freeman, 13 High Street, Linton, Cambridge CB1 6HS, both of Great Britain

[21] Appl. No.: 671,830

[22] PCT Filed: Sep. 28, 1989

[86] PCT No.: PCT/GB89/01151

§ 371 Date: May 22, 1991

§ 102(e) Date: May 22, 1991

[87] PCT Pub. No.: WO90/03717

PCT Pub. Date: Apr. 5, 1990

[30] Foreign Application Priority Data

Sep. 28, 1988 [GB] United Kingdom ..... 8822707

[51] Int. Cl.[5] ..... H05B 6/76

[52] U.S. Cl. ..... 219/10.55 D; 219/10.55 E; 126/340; 99/DIG. 14

[58] Field of Search ..... 219/10.55 E, 10.55 F, 219/10.55 A, 10.55 R, 10.55 D, 405, 411; 99/DIG. 14, 451; 126/339, 340

[56] References Cited

U.S. PATENT DOCUMENTS

| | | | |
|---|---|---|---|
| 2,820,127 | 1/1958 | Argento et al. | 219/10.55 R |
| 2,956,144 | 10/1960 | Woodman | 219/10.55 R |
| 3,440,383 | 4/1969 | Smith | 219/10.55 R |
| 3,440,385 | 4/1969 | Smith | 219/10.55 R |
| 3,467,803 | 9/1969 | Ojelid | 219/10.55 R |
| 3,500,742 | 3/1970 | Tanguy et al. | 219/518 |
| 3,701,872 | 10/1972 | Levinson | 219/10.55 E |
| 3,934,106 | 1/1976 | MacMaster | 219/10.55 E |
| 4,304,974 | 12/1981 | Ikeda et al. | 219/10.55 F |
| 4,335,292 | 6/1982 | Tanaka et al. | 219/10.55 F |
| 4,762,973 | 8/1988 | Schultz | 219/10.55 E |

FOREIGN PATENT DOCUMENTS 1049019 1/1959 Fed. Rep. of Germany .

*Primary Examiner*—Philip H. Leung

*Attorney, Agent, or Firm*—Lee, Mann, Smith, McWilliams, Sweeney & Ohlson

[57] ABSTRACT

A microwave heating chamber (10) has a rectangular opening (12) into which a food support (14) is slidable, the support including a handle (20) and a wall (18) which serves to close and seal the chamber when inserted. The wall (18) may have thermal break (22) with the support to prevent heat being conducted to the wall and handle. The support (14) may have several superposed platforms each to support an item of food, and each may have a rotatable dish.

6 Claims, 2 Drawing Sheets

MICROWAVE HEATING APPARATUS WITH A COMBINED FOOD SCOOP AND DOOR

FIELD OF THE INVENTION

This invention concerns microwave-powered heating devices, and in particular heating apparatus for heating foodstuffs, more particularly for defrosting and heating to a serving temperature frozen pre-cooked foodstuffs.

BACKGROUND TO THE INVENTION

With the increasing demand for quick, hot snacks and so called "fast food", there is an increasing requirement to be able to process frozen pre-cooked foodstuffs ready for consumption. In particular, it is necessary to be able to heat up from the frozen condition a pre-cooked foodstuff to a serving temperature in the shortest possible time, and typically a temperature change from −17° C. to +74° C. must be achieved. Preferably the time should be as short as possible, and ideally should be well under one minute.

Conventional microwave ovens are not particularly well suited to this function, and it has been proposed to concentrate the available energy by providing a reflecting surface within a chamber into which microwave energy is transmitted so that the latter is focused generally into the region of the chamber in which the foodstuff is located. In this way the energy is concentrated into the foodstuff and the latter is raised in temperature at the maximum possible rate.

It is an object of the present invention to provide a more convenient heating chamber for certain foodstuffs.

SUMMARY OF THE INVENTION

According to the present invention there is provided heating apparatus comprising a heating chamber in which a foodstuff is to be heated using microwave energy; an opening in the chamber wall for giving access to the interior thereof for the insertion and removal of foodstuffs; and a closure member therefor which includes a handle on its exterior and a foodstuff supporting platform extending from its internal face, so that inserting food into the chamber and closing the chamber is effected in a single operation, the interior of the chamber being formed at least in part with a concave microwave energy-reflecting surface.

The concave microwave energy-reflecting surface will typically be in the form of a dome. The microwave energy is directed towards the concave surface to be reflected therefrom and generally focussed towards the food supporting platform. Other microwave-reflecting geometries may be used to achieve the desired effect.

In one embodiment of the invention, the chamber design is such that at least some of the microwave energy entering the chamber does not impinge directly on the foodstuff but can only reach the foodstuff after being reflected at least once.

According to a preferred feature of the invention the combined closure member and food supporting platform is in the form of a generally flat scoop of large area which can be slipped below a large area foodstuff such as a pizza or pie or quiche, and the large area platform provides the support for the foodstuff, and the closure is therefore fully removable from the chamber in a slidable manner.

Alternatively the closure may be pivotable between a first position, in which the food support platform is accessible through the opening in the chamber wall, and a second position in which the closure closes off the opening with the platform inside.

The platform may in this event be in the form of a high-sided tray to prevent foodstuffs from falling thereoff.

According to a further preferred feature of the invention the food supporting platform may be formed at least in part from an electrically conductive material in that in the presence of microwave radiation the platform becomes heated and assists in the heating-up process and also assists in browning the underside of the foodstuff.

In order to prevent the heat in the platform from being conducted away, particularly to the closure and the handle, a thermal break is preferably provided between the platform and at least the handle, if not also the closure.

Typically the thermal break comprises a thermal insulating material capable of withstanding high temperatures.

Since the browning effect may not be desirable throughout the heating process, the platform may be formed from a microwave transparent material such as glass or ceramic and include an internal cavity into which an element of a metallic or other microwave absorbing material can be inserted during the heating process, either automatically or manually, to cause the platform to heat up and assist in browning the underside of the foodstuff.

Where top browning in also required, the chamber may include a second platform of glass or ceramic or other microwave transparent material with a hollow interior also capable of having an element of microwave absorbing material such as metal, metal oxide or metal particles, inserted therein during a heating process.

Two or more platforms one above the other may be provided, each extending from the internal face of the closure, on which an appropriate number of similar foodstuffs, such as pizzas, may be located, thereby to simplify multiple orders.

Each platform may include a rotatable dish to enable foodstuffs located thereon to be rotated within the chamber, to improve the uniformity of the heating and browning, where provided.

BRIEF DESCRIPTION OF THE DRAWINGS

The invention will now be described by way of example with reference to the accompanying drawings in which.

DETAILED DESCRIPTION OF THE INVENTION

Figure 1:
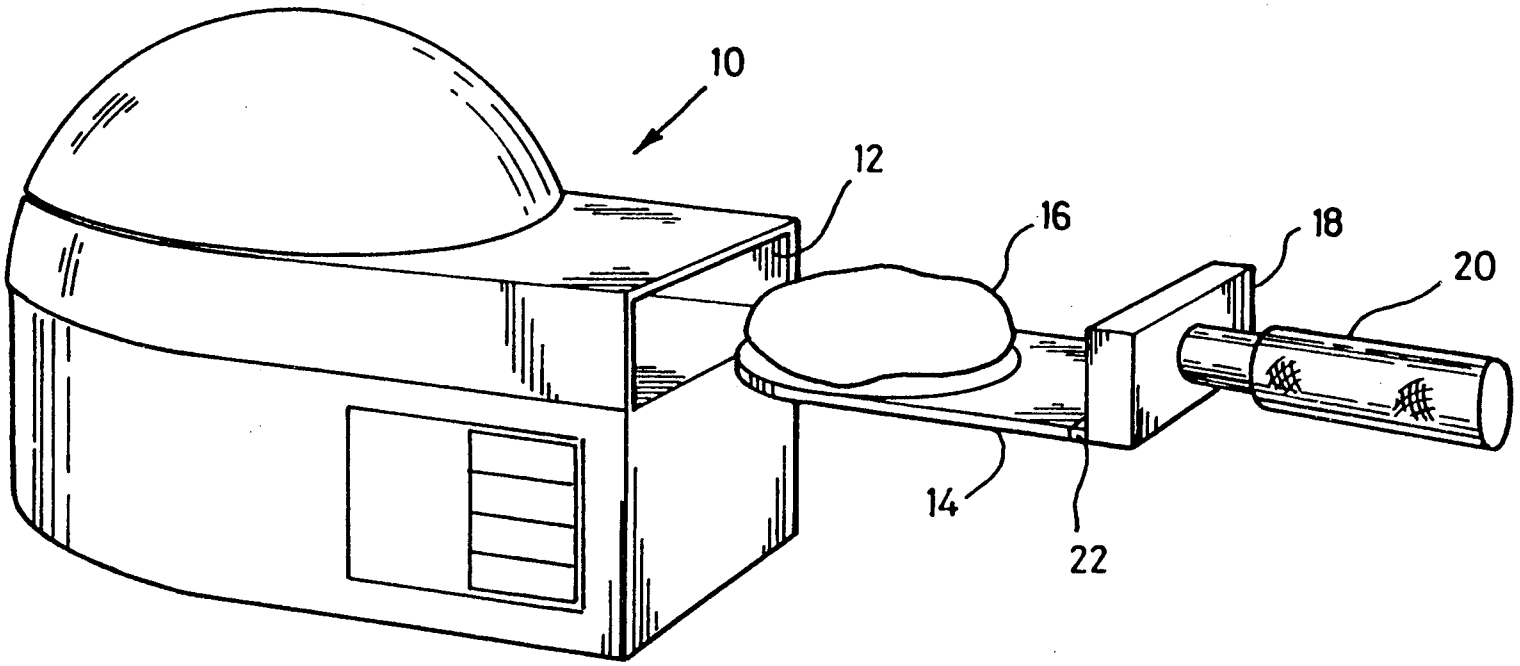
FIG. 1 is a perpective view of a microwave heating chamber embodying the invention and adapted to heat generally flat foodstuffs such as pizzas.

As shown in FIG. 1, a microwave powered heating chamber 10 includes a rectangular opening 12 through which food can be inserted into the chamber. A closure is provided in the form of a flat scoop 14 having a platform for supporting a pizza 16 or the like, having an upstanding wall section 18 which conforms to the opening 12 and just closes and seals same when the scoop 14 has been fully inserted.

A handle 20 is provided by which the scoop can be pushed in and pulled out.

The food-bearing section of the scoop 14 is formed from glass or ceramic or some other microwave-transparent material to prevent it becoming hot. Alternatively, this section of the scoop could be deliberately made from a microwave-absorbing material, deliberately to become hot in a controlled way, and so to brown or crisp or cook the underside of the foodstuff. The wall 18 must of course be formed from microwave-opaque or microwave-reflecting material such as metal and a thermal break is provided (if required) at 22 to prevent the transfer of heat from the platform 14 to the wall 18 and thence to the handle 20.

Figure 2:
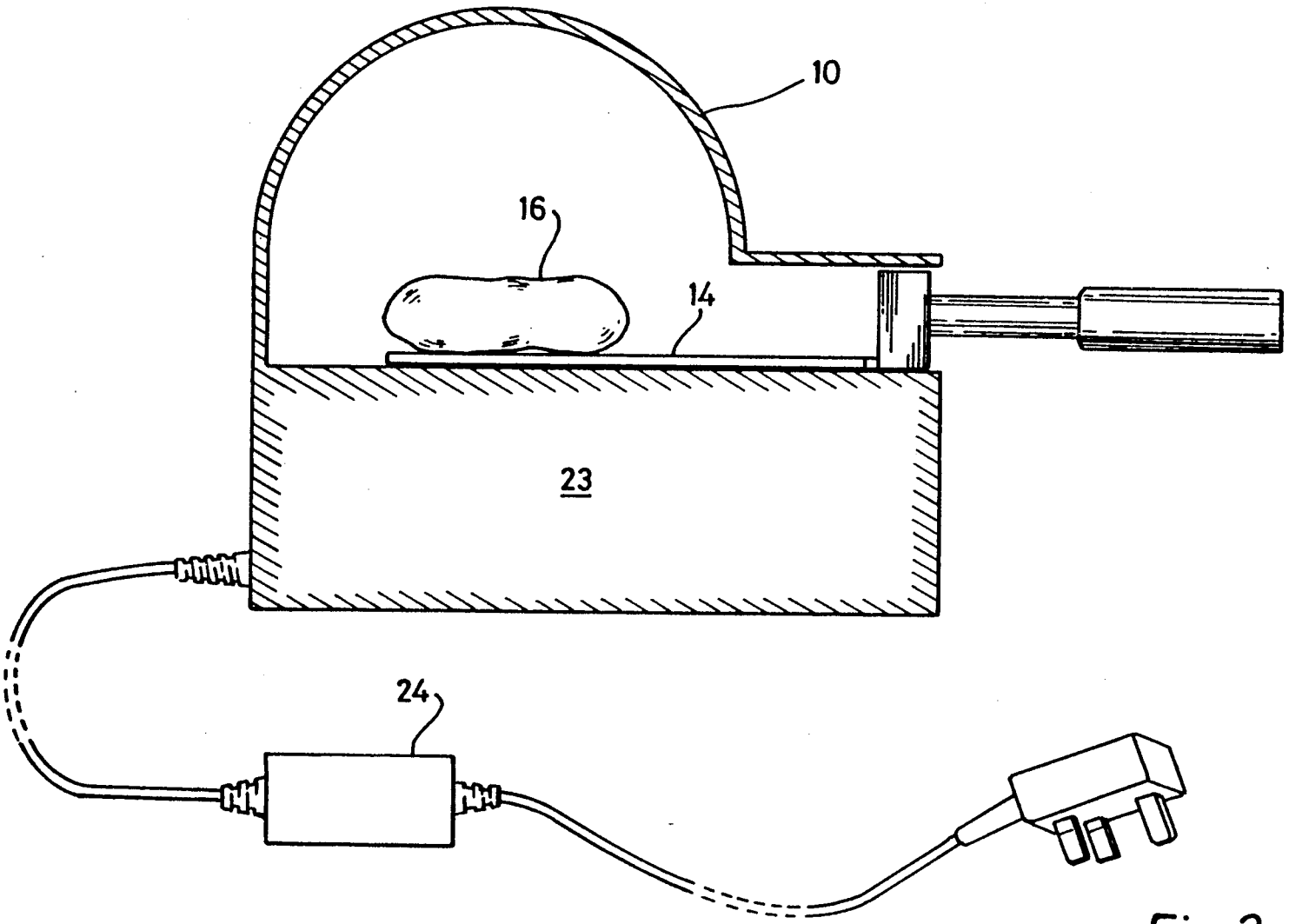
FIG. 2 is a side view partly in section of the unit shown in FIG. 1, with the closure and food platform inserted.

FIG. 2 shows the scoop 14 fully inserted into the heating chamber 10. Below the platform of the scoop is a microwave source 23 (not shown) such as a magnetron and the inside of the domed region of the chamber is formed from, or coated with microwave reflecting material such as metal so that energy incident thereon is reflected and focussed back towards the foodstuff 16.

A power supply may be located within the housing 10 or in the line as at 24.

We claim:

1. A microwave-powered heating apparatus comprising a heating chamber formed internally with a concave surface for reflecting microwave energy; a microwave source for directing microwave energy into the chamber; an opening formed in the chamber to enable insertion and removal of foodstuff to be heated; and a fully removable closure member for closing said opening and having a substantially horizontal platform for supporting foodstuff, said platform being generally in the form of a flat scoop onto which can be slipped a foodstuff of relatively large area, whereby the insertion of the foodstuff into the chamber and the closing of said opening is effected in a single operation.

2. Apparatus according to claim 1, wherein the concave reflecting surface is in the form of a dome.

3. Apparatus according to claim 1, in which the chamber design is such that at least some of the microwave energy entering the chamber does not impinge directly on the foodstuff but can only reach the foodstuff after being reflected from said concave surface.

4. Apparatus according to claim 1 in which the food supporting platform is formed at least in part from an electrically conductive material, so that in the presence of microwave radiation the platform becomes heated and assists in the heating-up process and also assists in browning the underside of the foodstuff.

5. Apparatus according to claim 4 in which said closure member comprises an external handle, and in which a thermal break is provided between the platform and the handle.

6. Apparatus according to claim 5 in which the thermal break comprises a thermal insulating material capable of withstanding high temperatures.

* * * * *